US009200515B2

(12) United States Patent
Ristau

(10) Patent No.: US 9,200,515 B2
(45) Date of Patent: Dec. 1, 2015

(54) RISTAU CONICAL ROTOR ORBITAL ENGINE

(71) Applicant: Judson Paul Ristau, Medford, OR (US)

(72) Inventor: Judson Paul Ristau, Medford, OR (US)

( * ) Notice: Subject to any disclaimer, the term of this patent is extended or adjusted under 35 U.S.C. 154(b) by 56 days.

(21) Appl. No.: 14/034,507

(22) Filed: Sep. 23, 2013

(65) Prior Publication Data

US 2015/0004037 A1 Jan. 1, 2015

Related U.S. Application Data

(60) Provisional application No. 61/705,052, filed on Sep. 24, 2012.

(51) Int. Cl.

| | |
|---|---|
| ***F03C 4/00*** | (2006.01) |
| ***F01C 1/00*** | (2006.01) |
| ***F01C 9/00*** | (2006.01) |
| ***F04C 9/00*** | (2006.01) |
| ***F01C 21/10*** | (2006.01) |

(52) U.S. Cl.
CPC *F01C 9/005* (2013.01); *F01C 21/10* (2013.01)

(58) Field of Classification Search
CPC ..... F01C 1/00; F01C 9/007; F04C 9/007; F03C 4/00
USPC ..... 418/68
See application file for complete search history.

(56) References Cited

U.S. PATENT DOCUMENTS

| | | | | |
|---|---|---|---|---|
| 2,316,107 | A * | 4/1943 | Zorro | 418/68 |
| 3,857,370 | A | 12/1974 | Hemenway | |
| 3,985,110 | A | 10/1976 | Doundoulakis | |
| 4,901,694 | A | 2/1990 | Sakita | |
| 6,195,992 | B1 | 3/2001 | Nommensen | |
| 6,289,867 | B1 | 9/2001 | Free | |
| 7,284,373 | B1 | 10/2007 | Benson | |
| 7,435,064 | B2 * | 10/2008 | Huttlin | 418/68 |
| 7,677,208 | B2 | 3/2010 | Greenwell | |
| 7,980,080 | B2 | 7/2011 | Pickette et al. | |
| 8,096,118 | B2 | 1/2012 | Williams | |
| 8,152,504 | B2 * | 4/2012 | Didin et al. | 418/68 |
| 2006/0260563 | A1 | 11/2006 | Dick et al. | |
| 2008/0050258 | A1 | 2/2008 | Wright | |
| 2009/0185937 | A1 * | 7/2009 | Didin et al. | 418/68 |
| 2009/0188460 | A1 * | 7/2009 | Wagner | 123/18 R |
| 2011/0214638 | A1 | 9/2011 | Groves | |

FOREIGN PATENT DOCUMENTS

| | | | |
|---|---|---|---|
| GB | 388342 | A | 2/1933 |
| WO | WO8400997 | A1 | 3/1984 |
| WO | WO2015042508 | A1 | 3/2015 |

OTHER PUBLICATIONS

International Search Report and Written Opinion, PCT/US2014/056733, WO/2015042508, dated Dec. 16, 2014.

* cited by examiner

*Primary Examiner* — Mary A Davis
(74) *Attorney, Agent, or Firm* — Law Office of Sam Sokhansanj PLLC

(57) ABSTRACT

A rotary thermal engine for generating mechanical energy. The rotary thermal engine includes an engine block having an enclosed interior space, a first rotor and a second rotor, a first disc coupled to the first and second rotor. A second disc is positioned between the first and second rotor, wherein the second disc pivots relative to the first disc. In addition, wherein the first and second rotors and first and second discs are at least partially enclosed within the interior space of the engine block.

19 Claims, 13 Drawing Sheets

RISTAU CONICAL ROTOR ORBITAL ENGINE

CROSS REFERENCE TO RELATED APPLICATIONS

This application claims the benefit of U.S. Provisional Application No. 61/705,052 filed on Sep. 24, 2012, which is incorporated herein by reference in its entirety

FIELD OF THE INVENTION

The present invention relates generally to thermodynamic cycle heat engines. In particular, the present invention is an apparatus and method for utilizing fluid pressure to drive dual adjacent rotating cones in conjunction with a rotating disc in order to generate mechanical energy or electrical energy.

BACKGROUND

This section is intended to introduce the reader to aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Engines having one or more rotational rotors are known to have numerous theoretical advantages over conventional engines utilizing linearly reciprocating pistons. Such advantages include smoother operation and improved engine balancing, fewer moving parts, lower frictional losses, and reduced size, weight, and cost. Most rotary engines also suffer, however, from one or more significant disadvantages which have severely limited their commercial acceptance. The type of rotary engine most commonly produced at this time utilizes an Otto cycle and an eccentric rotor, which significantly increases the complexity and manufacturing costs of the engine. Other rotary engines utilize a complex arrangement of planetary gears and cranks to operate connecting arms, multiple crankshafts, or sophisticated rhombic drives, thereby making the engine difficult to balance and expensive to manufacture.

Most engine designs are based directly on or are a slight variant of either the Ericsson cycle, the Stirling cycle, or the Otto cycle. An analysis of the thermodynamics of these engine cycles reveals that the Ericsson cycle theoretically provides the most work. The high volumetric displacement required for the constant pressure heating and cooling of this cycle, however, significantly increases the size of the engine and thus limits the practicality of utilizing this cycle for most applications.

The Otto cycle is well suited for engines in which combustion of a fuel occurs within an internal working chamber of the engine. The efficiency of the Otto cycle internal combustion engine is limited, however, by the temperature of the incoming gas. The efficiency of an engine utilizing the Otto cycle cannot, however, be continually increased by raising the temperature of the incoming gas, since gas temperature must be kept sufficiently low in order to prevent detonation (knocking) which severely detracts from engine performance.

The theoretical Stirling cycle achieves isothermal compression and expansion, with constant volume heating and cooling. This cycle has the advantage of theoretically increased efficiency over the Otto cycle, yet an engine utilizing this cycle does not require the substantially increased size and complexity of an Ericsson cycle engine. Rotary engines based upon the Stirling cycle seeking to combine the benefits of high efficiency for the Stirling cycle with the advantages of a rotary engine, utilize an offset axis for the rotor shaft and thus require displacer rotor vanes which move radially to maintain sealing integrity with the outer housing wall. The complexity, wear, and increased balancing problems created by this offset axis arrangement thus substantially detract from the previously disclosed benefits of a rotary engine.

BRIEF SUMMARY OF THE INVENTION

The disadvantages of traditional rotary engines are overcome by the present document describing an improved Ristau Orbital Engine operating on a pressure differential. The Ristau Orbital Engine being adaptable to a wide range of pressure differentials that are naturally occurring or fuel generated. The Ristau Orbital Engine is well-suited for many applications for maximum engine efficiency, reliability, and smoothness of operation coupled with a minimum engine size, weight, and complexity.

The Ristau Orbital Engine is hereinafter disclosed which more fully combines the benefits and advantages of a reciprocating engine with the benefits and advantages of a turbine further incorporating less working components and improved efficiency.

In one aspect of the invention, a rotary thermal engine is provided that includes an engine block having an enclosed interior space, a first rotor and a second rotor, a first disc coupled to the first and second rotor, a second disc positioned between the first and rotor, wherein the second disc pivots relative to the first disc, and wherein the first and second rotors and first and second discs are at least partially enclosed within the interior space of the engine block.

In addition, the rotary thermal engine further includes a drive shaft coupled to the first or second rotor and wherein the second disc includes an elongated opening for receiving the first disc.

Also, the rotary thermal engine further includes one or more ports on the engine block in communication with the interior space of the engine block. The engine block further includes a first block and a second block coupled to each other.

The first and second rotor of the rotary thermal engine are further configured to rotate about an axis. In addition, the first and second discs form at least two separate chambers within the interior space of the block. Also, the first block and second block each have an inlet and outlet port.

The rotary thermal engine further includes a first and second chamber that are created within the interior space of the first block, and a third and fourth chamber are created within the interior space of the second block. The first, second, third, and fourth chamber each communicate with at least one port for receiving or expelling air.

In another aspect of the invention, a rotary thermal engine is provided having an engine block having an enclosed interior space for receiving a working fluid. The rotary thermal engine further includes a rotor, a first disc coupled to the rotor, a second disc adjacent to the rotor, wherein the second disc pivots relative to the first disc, and wherein the rotor and first and second discs are at least partially enclosed within the interior space of the engine block.

In addition, the rotor is further coupled to a drive shaft and the working fluid is at least partially pressurized within the interior space. Also, the pressurized working fluid causes the rotor to rotate about an axis. The working fluid can include one or more of air, water, gas, or hydrocarbon. The working fluid can also be from a geothermal source. Further, the working fluid enters the engine block from an inlet port, is then expanded within the interior space of the engine block, and then expelled from the interior space through an outlet.

In another aspect of the invention, a method of generating energy using a rotary thermal engine is provided. The method includes receiving a working fluid at the engine from a source, expanding the working fluid within a chamber of the engine, wherein the expanded working fluid causes one or more discs coupled to a rotor to rotate, thereby generating rotational energy at a drive shaft coupled to the rotor, and expelling the working fluid from the chamber of the engine. In addition, the working fluid can be comprised of one or more of air, water, gas, and hydrocarbon.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

FIGURES

Reference Numerals

| |
|---|
| 30 Block |
| 31a Port |
| 31b Port |
| 32 Spherical cavity |
| 33 Seating surface |
| 34 Shaft opening |
| 35 Shaft |
| 36 Bearing |
| 37 Angled surface |
| 38 Seating surface |
| 39a Conical rotor |
| 39b Conical rotor |
| 40 Center bearing |
| 41a Disc or Vane |
| 41b Disc or Vane |
| 42 Disc connection area |
| 43 Disc outside edge |
| 44 Disc rotor |
| 45 Disc rotor slot |
| 46 Disc rotor slot center |
| 47 Disc rotor slot edges |
| 48 Conical rotor base |
| 49 Disc rotor angle |
| 50 Heat collector |
| 51 Heat sink |
| 52a Ristau Orbital Engine |
| 52b Ristau Orbital Engine |
| 53 Chambers |
| 54 Silhouette of the cavity created by the Ristau Orbital Engine block |
| 55a Ristau Orbital Engine |
| 55b Ristau Orbital Engine |
| 56 Combustion chamber |
| 57 Ristau Orbital Engine |

DETAILED DESCRIPTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 4:
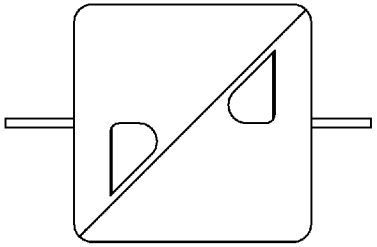
FIG. 4 illustrates a side view of the Ristau Orbital Engine, as assembled.
Figure 3:
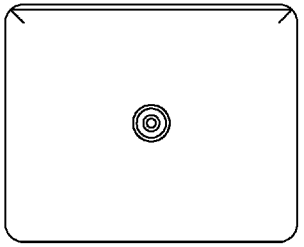
FIG. 3 illustrates a front view of the Ristau Orbital Engine, as assembled, with the back view being identical to the front view.
Figure 2:
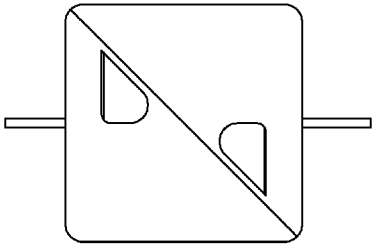
FIG. 2 illustrates a side view of the Ristau Orbital Engine, as assembled.
Figure 5:
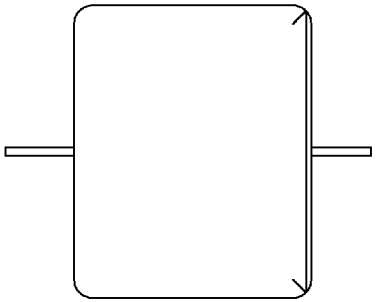
FIG. 5 illustrates a top view of the Ristau Orbital Engine, as assembled, with the bottom being identical as the top view, as assembled.
Figure 1:
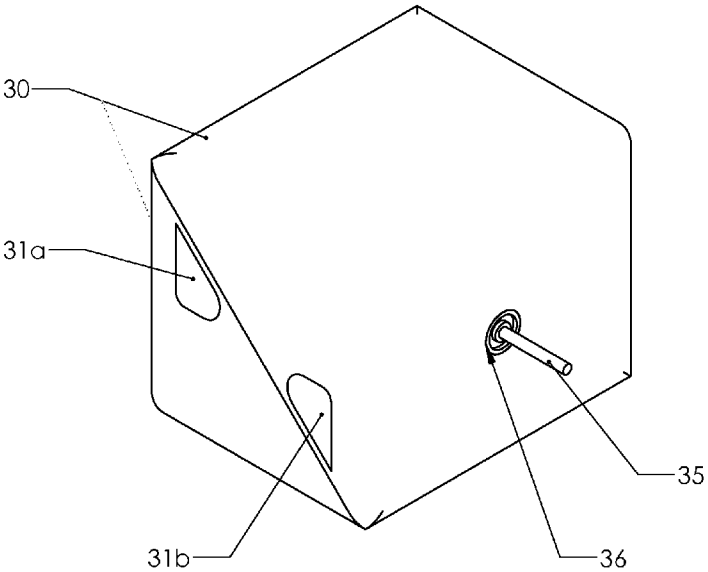
FIG. 1 illustrates a perspective view of the Ristau Orbital Engine, as assembled.
Figure 6:
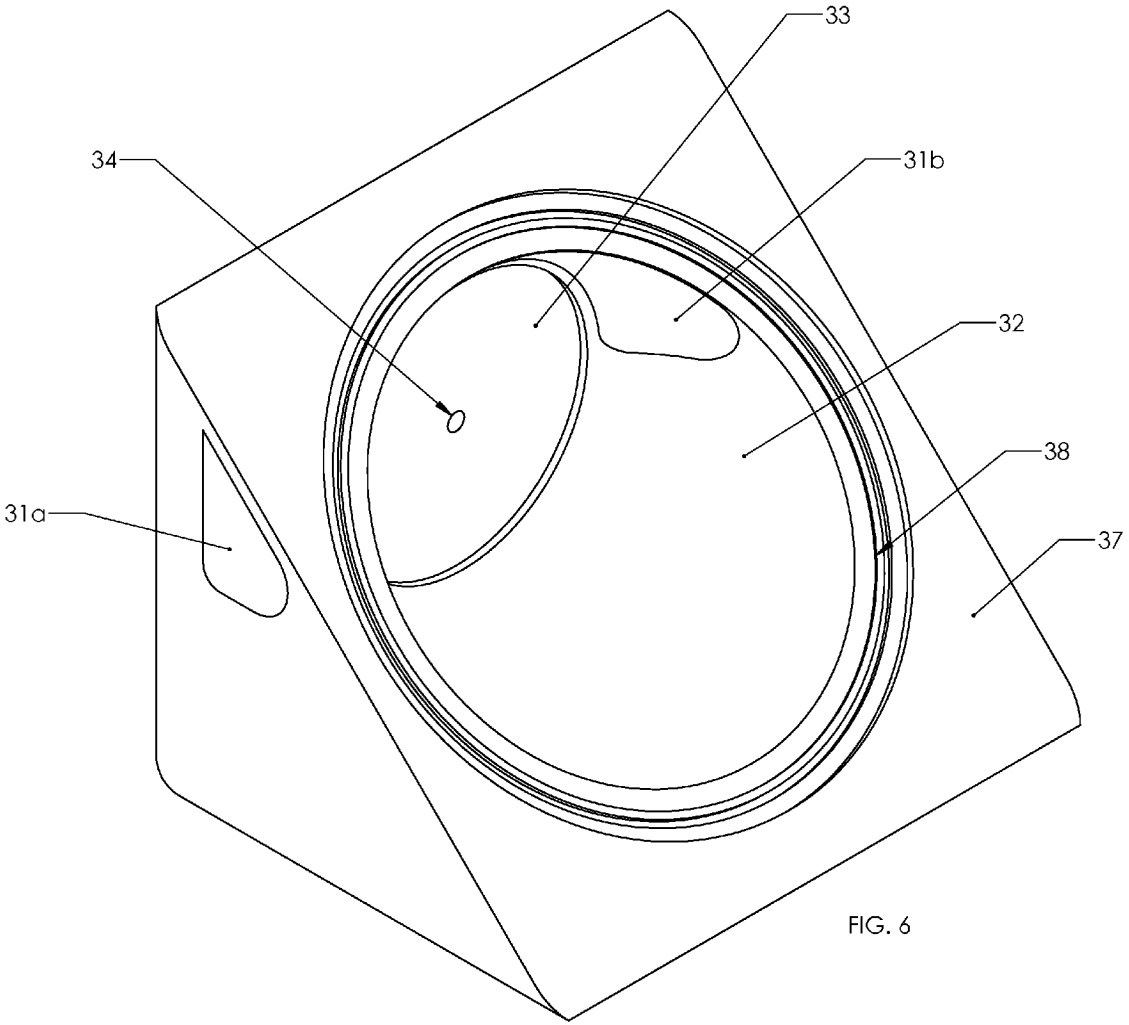
FIG. 6 illustrates a perspective view of one half block of the Ristau Orbital Engine.
Figure 7:
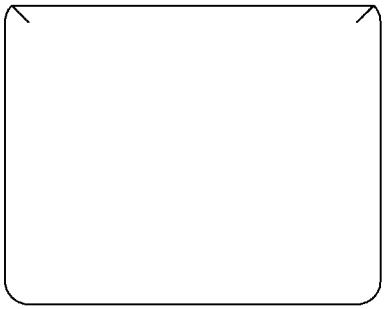
FIG. 7 illustrates a bottom view of the one half block for the Ristau Orbital Engine.
Figure 9:
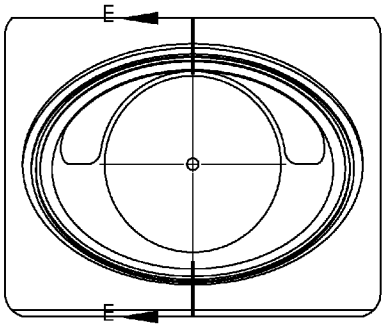
FIG. 9 illustrates a front view of the one half block for the Ristau Orbital Engine.
Figure 10:
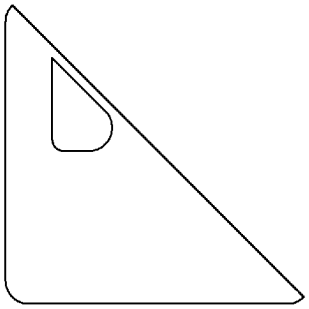
FIG. 10 illustrates a side view of the one half block for the Ristau Orbital Engine.
Figure 11:
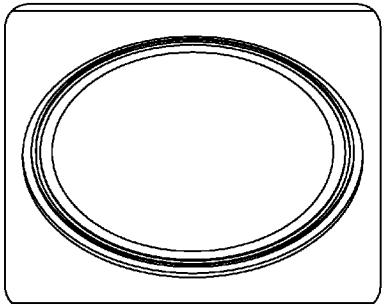
FIG. 11 illustrates a top view of the one half block for the Ristau Orbital Engine.
Figure 8:
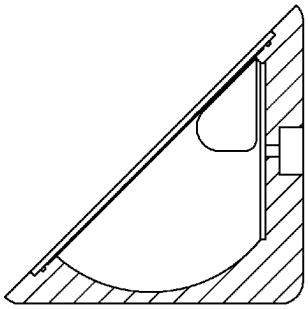
FIG. 8 illustrates a side cross sectional view of the one block for the Ristau Orbital Engine.

FIGS. 1-5 illustrate multiple views of one embodiment of the Ristau Orbital Engine of the present invention, wherein FIG. 1 illustrates the Ristau Orbital Engine in assembled configuration. The Ristau Orbital Engine has a block 30 which is comprised of two symmetrical halves, wherein one half block is shown in FIG. 6. The block 30 is comprised of a square box or rectangular like configuration. However, it is contemplated within the scope of the invention that the bock may take on any shape, size, configuration, or dimension, including but not limited to rectangular, cylindrical, triangular, square, ellipsoid, parallelogram, or any polygon configuration having three or more sides. Further, it is contemplated within the scope of the invention that the block may be one unitary piece. Referring to the FIG. 6, one half of the full block 30 is shown, wherein each half mirrors the other. Each half block has two ports 31*a* and 31*b* on opposing sides and extending to the exterior surface of the block. Each port, 31*a* or 31*b*, may function as either an inlet or outlet. The interior of each half block provides a spherical opening or cavity 32. The spherical opening 32 that accommodates operation of the interior parts, such as the core assembly and disc rotor, which will later be described in detail. The spherical opening also provides a wall of one or more expanding and contracting chambers 53, shown in FIG. 21. Still referring to FIG. 6, the block has a circular flat surface or face 33 on the interior front and back or end wall surface of the spherical cavity. The flat surface 33 serve as a seat for seals and moving components. The flat surface is not necessary for the proper function of the Ristau Orbital Engine but is present in this embodiment to eliminate a void or dead space. For example, in other embodiments, in lieu of or in addition to flat surface 33, the void created by a continuation of the block cavity can provide a reservoir for lubricant for the various moving parts and components. The center of the flat surface 33 inside the spherical cavity is shown to have a circular opening 34 extending to the exterior surface of the block. The opening 34 allows for a shaft 35 and any conventional bearing 36 or seal to be used to transfer mechanical energy from the moving interior components to the exterior or alternately for mechanical energy to be applied from the exterior in order to move the interior components of the Ristau Orbital Engine. The size of the opening 34 depends on the size of the shaft 35 being used.

Still referring to FIG. 6, the angled surface 37 of the block half is shown having seating 38 for internal components such as the core assembly and rotors. The seating is designed to keep components centered and positioned on a designated plane. The angled surface 37 couples and mates with the angled surface of a second block half to form a full block as illustrated in FIG. 1-5. FIGS. 7-11 further illustrate multiple views of one half of the block. The two block halves may be connected by any conventional means including but not limited to: various welding techniques, casting, printing, soldering, brazing, MIG, TIG, laser, electron beam, resistance, or plasma welding procedures. In addition, components can be further coupled via any type of screws or rivets known to one of ordinary skill in the art. It is further contemplated that the blocks may comprise of any suitable material, including steel, stainless steel, aluminum, nickel, titanium, ceramics, composites and alloys. Alternatively, the block may be one unitary component.

Figure 12:
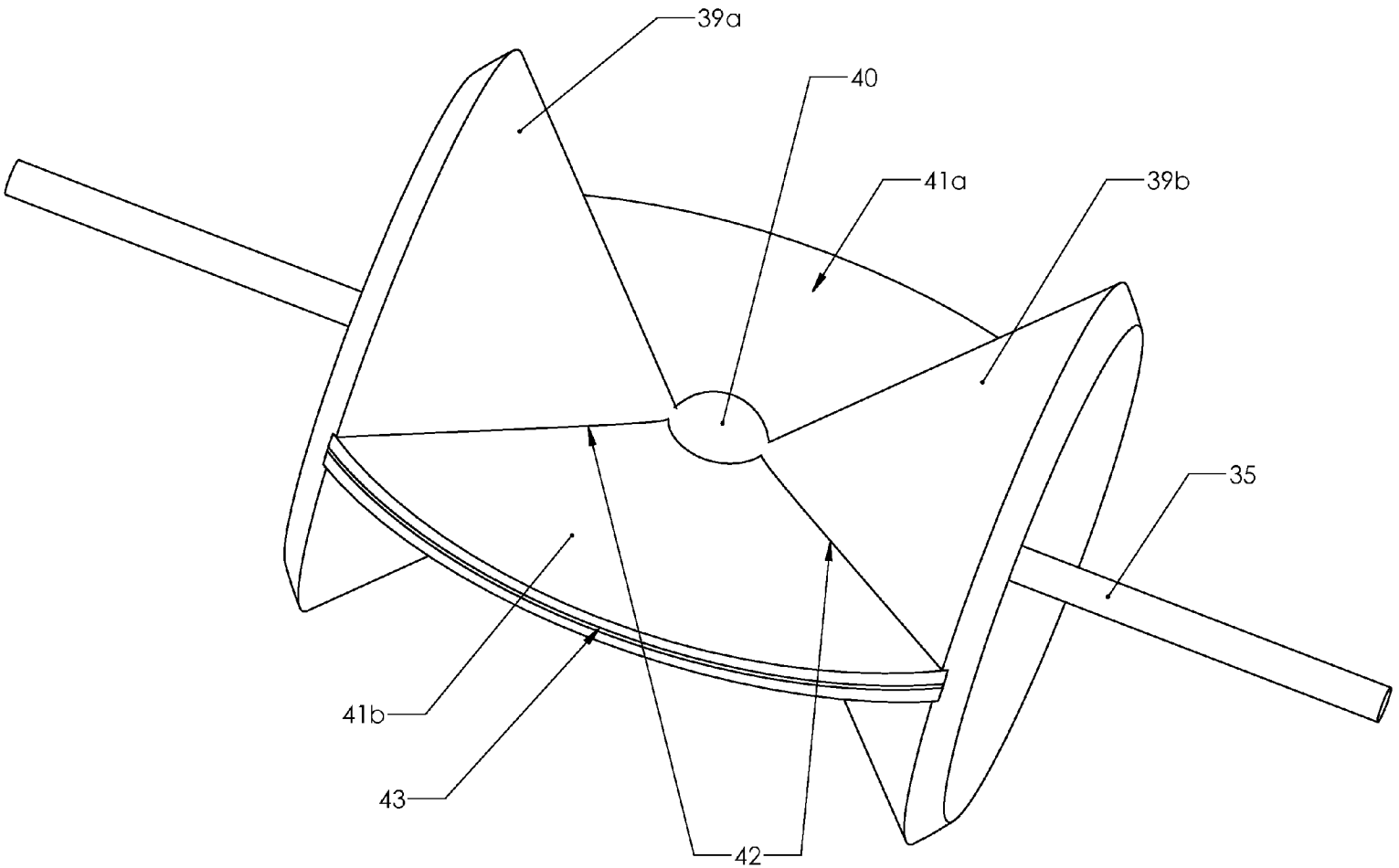
FIG. 12 illustrates a perspective view of a core assembly for the Ristau Orbital Engine.
Figure 14:
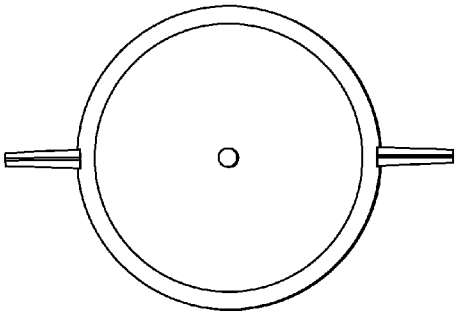
FIG. 14 illustrates a front view of the core assembly for the Ristau Orbital Engine, the back view being identical to the front view.
Figure 16:
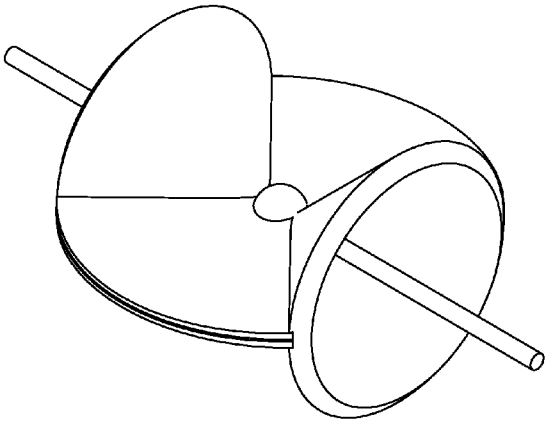
FIG. 16 illustrates a perspective view of the core assembly for the Ristau Orbital Engine.
Figure 13:
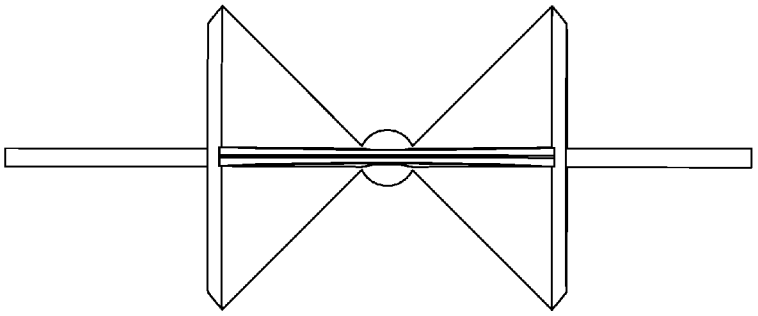
FIG. 13 illustrates a side view of the core assembly for the Ristau Orbital Engine.
Figure 15:
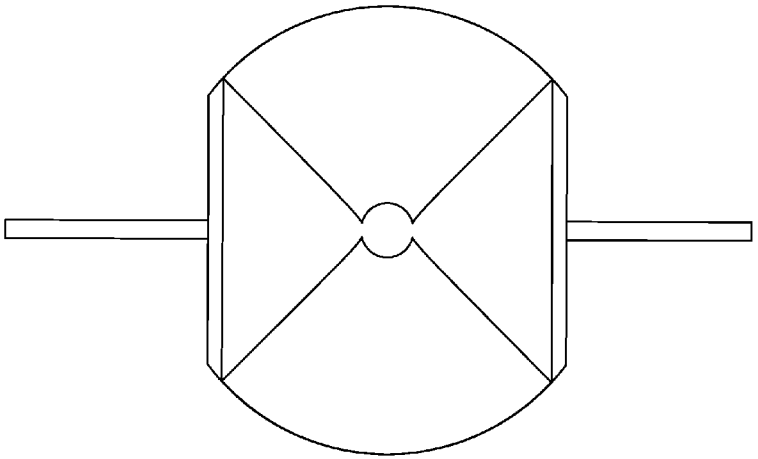
FIG. 15 illustrates a top view of the core assembly for the Ristau Orbital Engine, the bottom view being identical to the top view.

FIG. 12 illustrates one embodiment of the core assembly. The core assembly is a rigid unit that may be made as a single unitary part or comprised of separate individual components. For the purpose of thorough explanation, each section of the core assembly will now be explained separately.

The core assembly has two conical shaped rotors 39*a* and 39*b* aligned on a shaft 35 with the base of each conical rotor centered on the shaft axis with the apex of each conical rotor centered on the shaft axis and oriented toward the center. The apex end of the conical rotors terminate on a center bearing 40 at the center of the assembly. The center bearing 40 defines the center of the moving parts and serves to maintain the orientation of the moving parts in relation to each other. The center bearing 40 further assists in maintaining a proper seal between the moving parts. The center bearing 40 may range in size so long as an adequate seal between it and the moving parts are maintained. The center bearing 40 is shown to be a spherical bearing, however, it is contemplated within the scope of this invention that any type of junction component may be used for vanes or discs 41*a*, 41*b* and conical rotors 39*a*, 39*b* may be incorporated.

Still referring to FIG. 12, the space between the conical rotors is bridged by one or more vanes, plates, or discs 41*a*, 41*b*. The discs (plates or vanes) 41*a*, 41*b* have a flat semi-circular shape. Further, the discs 41*a*, 41*b* can either be individual separate components coupled together or discs 41*a*, 41*b* can be one unitary component. The angles or disc connection area 42 of each disc connect to the exterior surface of the conical rotors. The apex of each disc connects to the center bearing. The outer edge 43 of each disc has a circular profile that seals with the interior surface of the spherical cavity of the block 32. The face of each disc 41*a*, 41*b* interacts with the slot 45 of a pivoting disc 44, as shown FIG. 17-19. The face of each disc 41*a*, 41*b* is slightly concave to allow for passage through the slot of the rotating disc while maintaining an adequate seal. Each disc is oriented parallel to the shaft axis. FIG. 13-16 further illustrate multiple views of the core assembly.

If the core assembly is built in parts, each part may be connected by any conventional means including but not limited to: various welding techniques, casting, printing, soldering, brazing, MIG, TIG, laser, electron beam, resistance, or plasma welding procedures. In addition, components can be further coupled via any type of screws or rivets known to one of ordinary skill in the art. It is further contemplated that it may comprise of any suitable material, including steel, stainless steel, aluminum, nickel, titanium, ceramics, composites and alloys.

Figure 18:
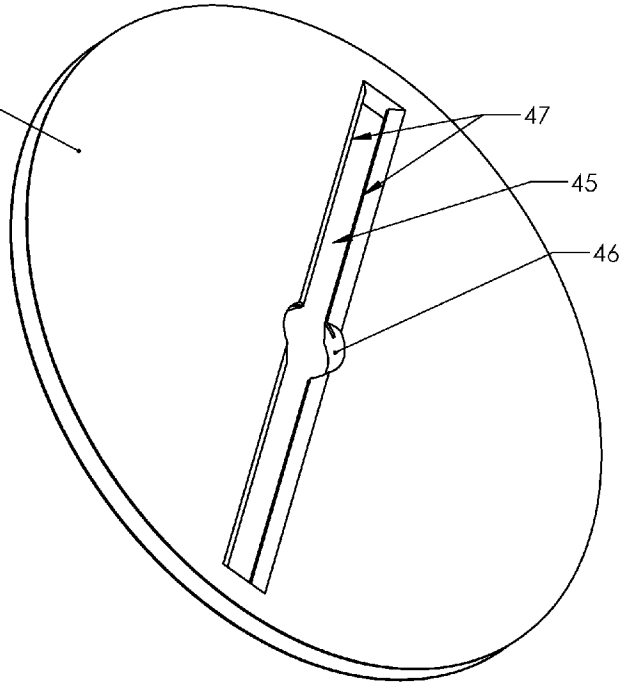
FIG. 18 illustrates a perspective view of the disc rotor for the Ristau Orbital Engine.
Figure 17:
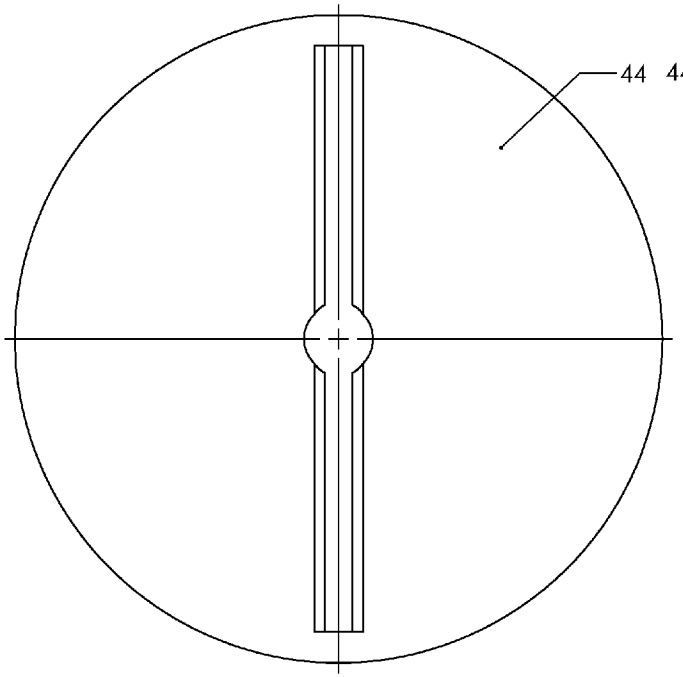
FIG. 17 illustrates a top view of a disc rotor for the Ristau Orbital Engine being identical to the bottom view.
Figure 19:
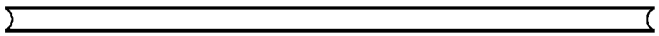
FIG. 19 illustrates a side view of the disc rotor for the Ristau Orbital Engine.

FIG. 17-19 illustrates multiple views of one embodiment of a disc rotor 44. The disc rotor 44 is circular in shape. The slotted portion 45 of the disc rotor allows the vanes to pass through it when the Ristau Orbital Engine is in motion. The center portion of the slot 46 acts as a seal with the center bearing 40. The slotted portions 45 that extend from the center are wide enough to allow vanes or discs 41*a*, 41*b* to pass through. The surface of the slot edges 47 are tapered or beveled to allow the angle of the disc rotor 44 to change in relation to the discs 41*a*, 41*b* during operation of the Ristau Orbital Engine. The flat faces of the disc rotor maintain a seal with the conical rotors. The thickness of the rotor is determined by the distance of the conical rotors from each other. The thickness of the rotor can be adjusted to accommodate the angle of the conical rotors 39*a*, 39*b*. The appropriate thickness of the disc rotor will allow a face of the disc rotor to maintain a seal with one of the conical rotors while the opposite face maintains a seal with the other conical rotor. The angle of the disc rotor is maintained by the seating area in the block 38 and the surfaces of the conical rotors. The disc rotor may comprise of any suitable material, including but not limited to steel, stainless steel, aluminum, nickel, titanium, ceramics, composites and alloy.

Figure 20:
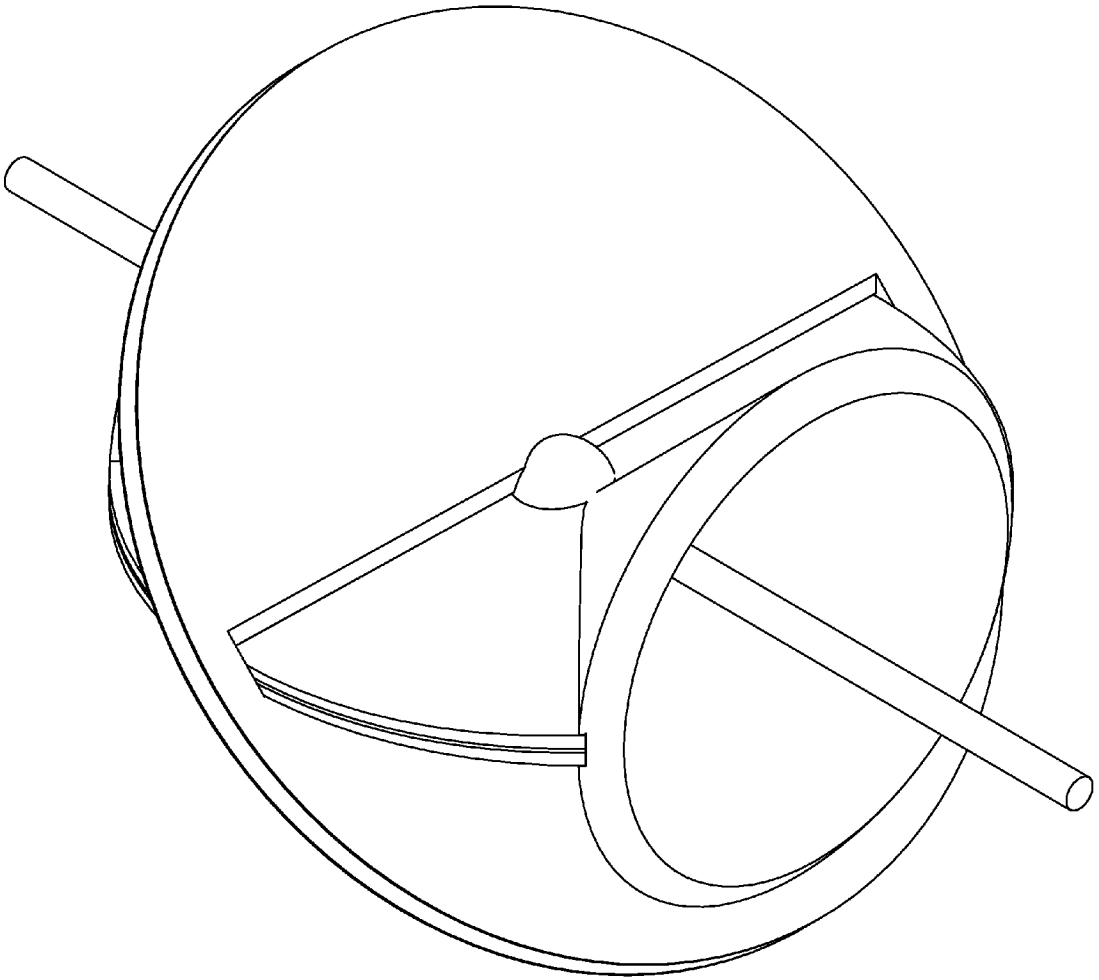
FIG. 20 illustrates a perspective view of the core assembly and disc rotor as assembled.
Figure 21:
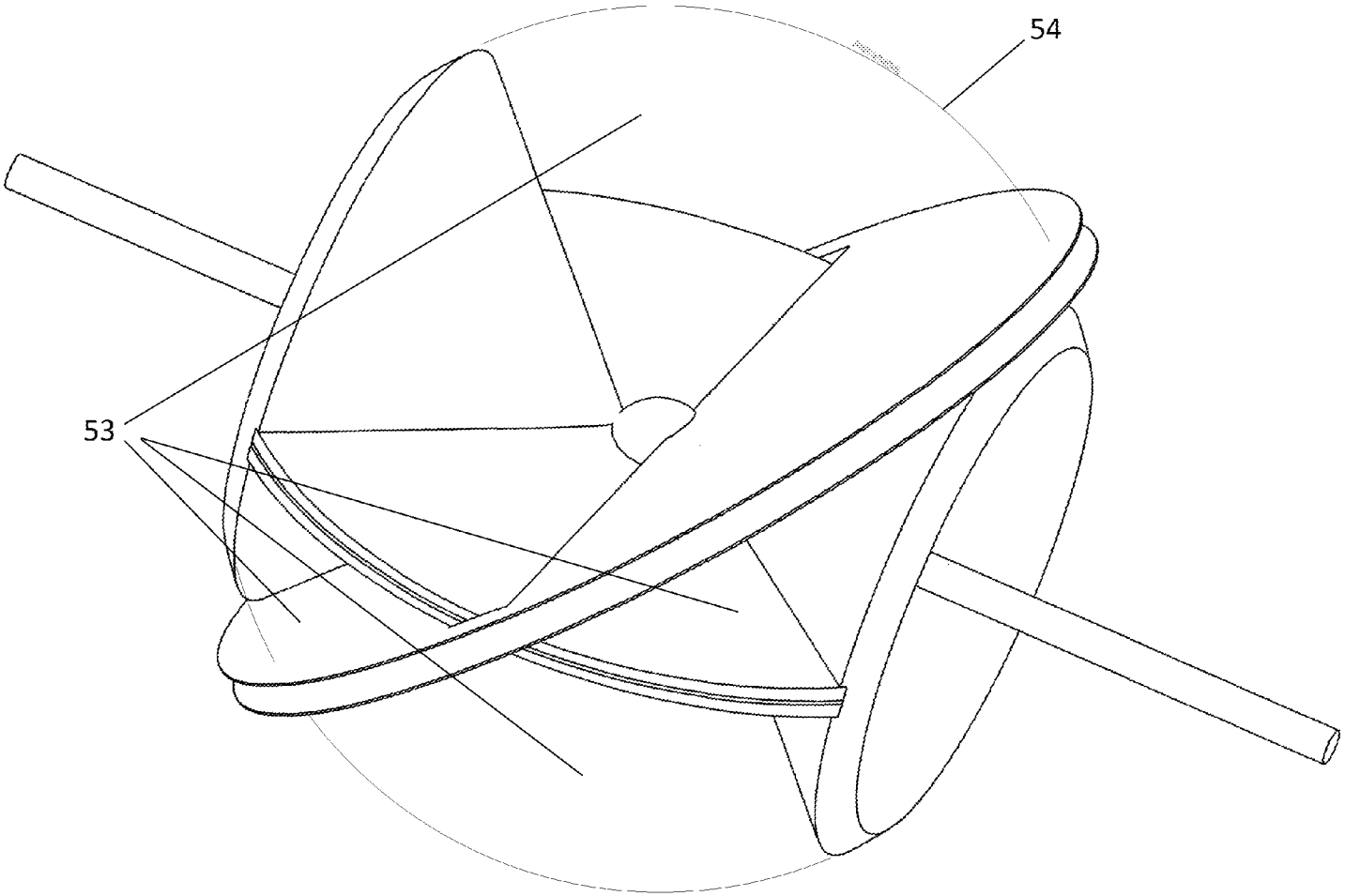
FIG. 21 illustrates chambers created by the surfaces of the Ristau Orbital Engine block, disc rotor and the core assembly.
Figure 22:
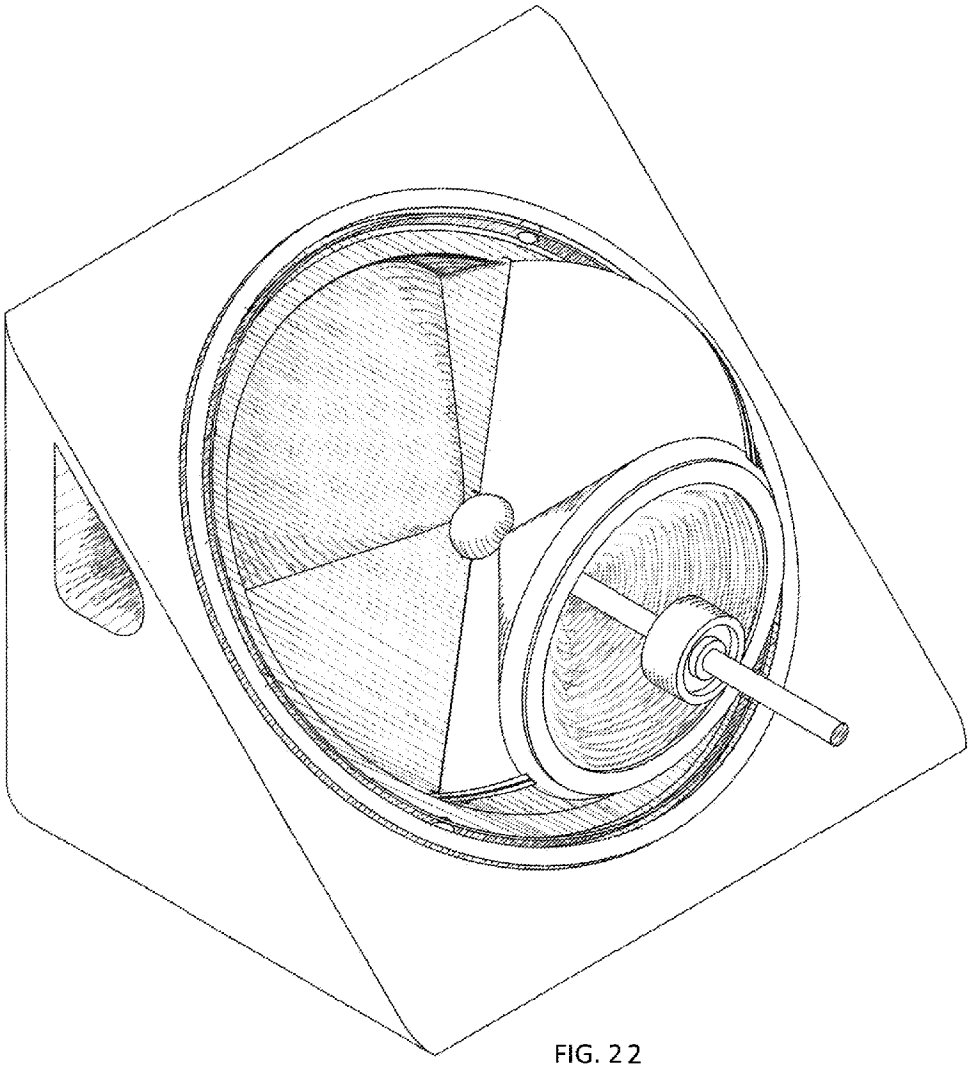
FIG. 22 illustrates the core assembly and rotor disc as assembled inside the lower Ristau Orbital Engine block with the top block being removed.

FIG. 20-21 illustrate the core assembly and disc rotor in relation to each other when assembled. The disc rotor is centered on the center bearing of the core assembly. The disc rotor seals with the center bearing of the core assembly. The disc rotor is also centered on the shaft axis but rotates on its own plane back and forth in the direction noted by arrows 54 and vice versa. The plane on which the disc rotor rotates is defined by the angle of the conical rotors. FIG. 22 illustrates the relationship between the core assembly, disc rotor and block in one embodiment of the Ristau Orbital Engine. The faces of the disc rotor seal inside of the seating area of each of the one half blocks. Conventional seals and bearings may be used in the seating area of the block half to maintain a seal and guide rotation of the disc rotor on its plane.

The core assembly sits inside of the spherical cavity of the block. The base of the conical rotors seal against the flat inside surface of the spherical void. The shaft extends to the exterior of the block on both the front and back sides of the block, however, it is contemplated within the scope of the invention that a shaft may extend to the exterior of only one or neither the front or back of the block. The outside edge of the discs 41*a*, 41*b* seals with the interior surface of the spherical cavity. When assembled the surfaces of the conical rotors, discs, disc rotor and spherical cavity (or interior portions) of the block constitute walls of chambers 53 which expand and contract in volume when the Ristau Orbital Engine is in motion. In the present embodiment the number of chambers changes between four (4) and six (6) depending on the core assembly's point of rotation. Rotation of the core assembly causes the chambers to vary in size, shape and relative location within the cavity created by the block of the Ristau Orbital engine.

Figure 23:
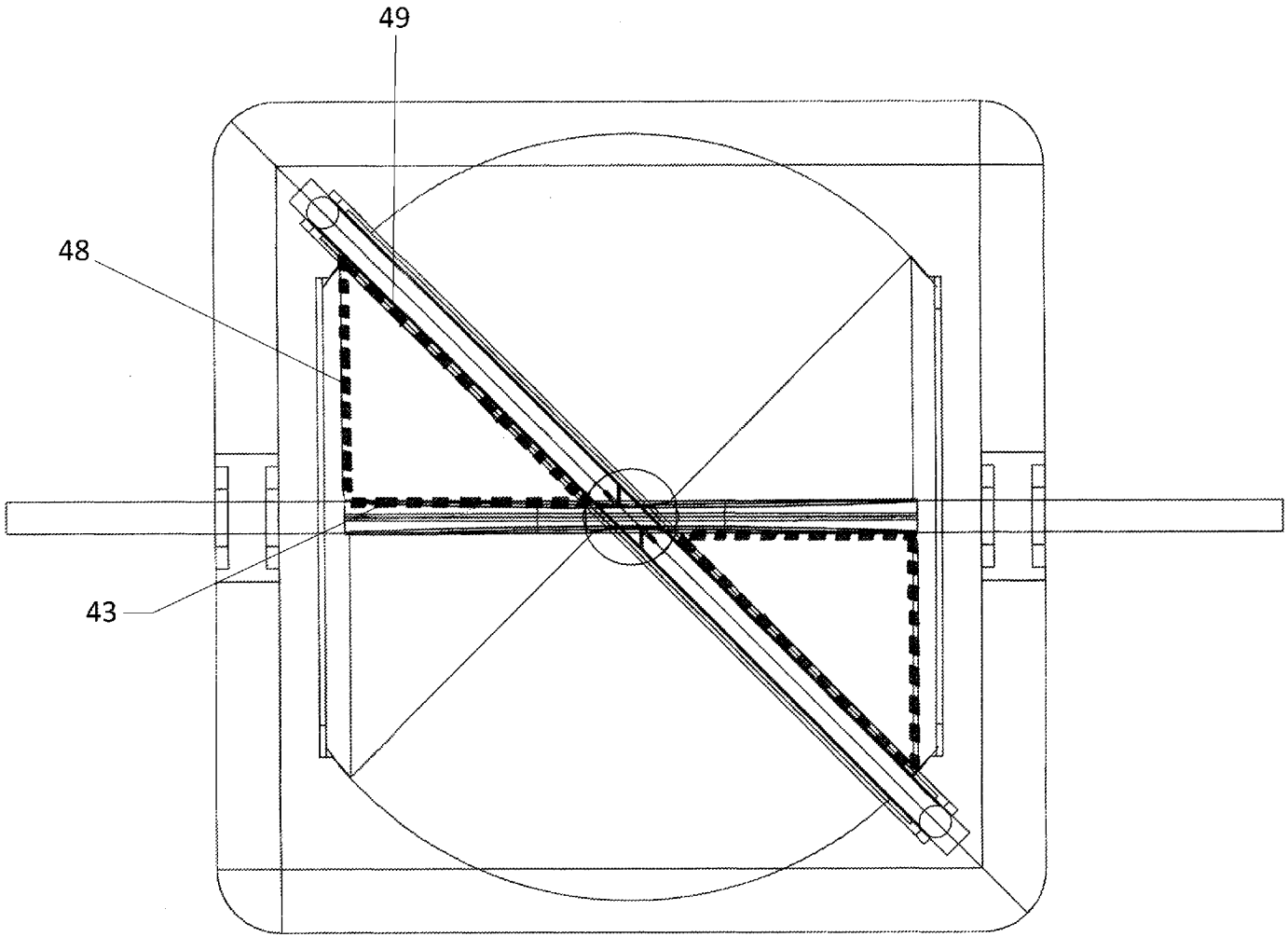
FIG. 23 illustrates one embodiment of inlet or outlet ports for the Ristau Orbital Engine block.

FIG. 23 illustrates a wire frame side view of the Ristau Orbital Engine. The shape of the ports 31*a*, 31*b* on the interior surface of the spherical cavity are designed to correspond to the outline of the sealing surfaces 48, 43 of the core assembly and sealing surface 49 of the disc rotor when the core assembly is oriented with the discs 41*a*, 41*b* extending horizontally from the shaft axis. The opening of the port(s) on the inside surface of the spherical void follow the outline of the sealing surface 48 of the conical rotor, surface 43 of the discs the outside edge of the vane, and surface 49 of the disc rotor. This minimizes areas of unintended compression and suction when the Ristau Orbital Engine is in motion, both of which introduce resistance to the system.

Figure 24:
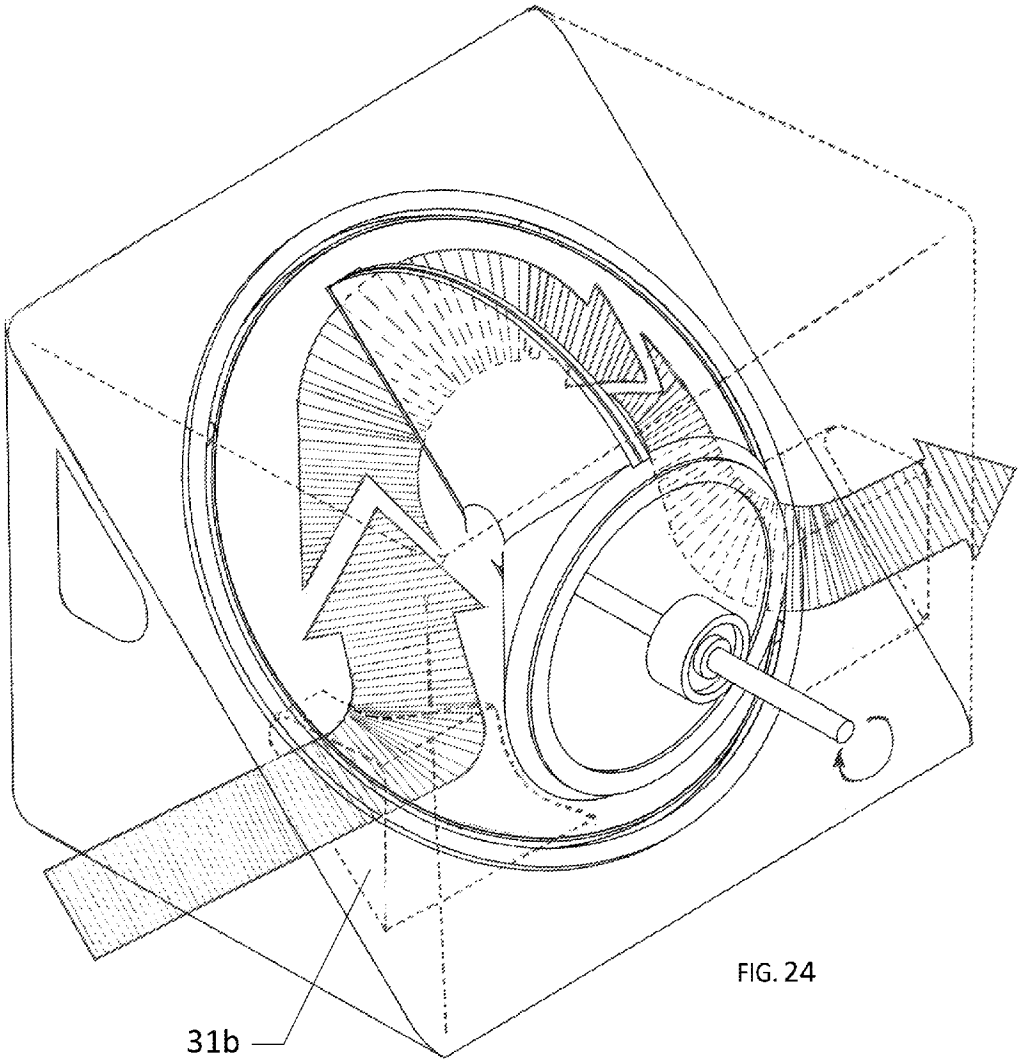
FIG. 24 illustrates the flow of working fluid through the Ristau Orbital Engine during operation.

FIG. 24 illustrates the flow of a working fluid through the Ristau Orbital Engine. A working fluid under pressure enters a port 31*b*. The pressure of the working fluid causes a chamber of the Ristau Orbital Engine to expand because of higher pressure on one face of a vane or disc (41*a* or 41*b*). Here, because the vane or disc is part of the core assembly attached to the conical rotors the assembly is forced to rotate around the shaft axis in a clockwise direction. The disc rotor 44 is also connected to the vanes or discs 41*a*, 41*b* via the seals between it and the discs along its slotted portion. The rotation of the core assembly along the shaft axis causes the disc rotor 44 to rotate or pivot on its own axis while allowing the vanes or discs 41*a*, 41*b* to slide through the slotted portion 45 of the disc rotor which creates an expanding chamber. The shape of the port allows working fluid to enter the expanding chamber until the chamber is at its largest capacity as illustrated by FIG. 25 at which point the largest chamber is closed to both ports and changes from an expanding chamber to a contracting chamber.

Figure 25:
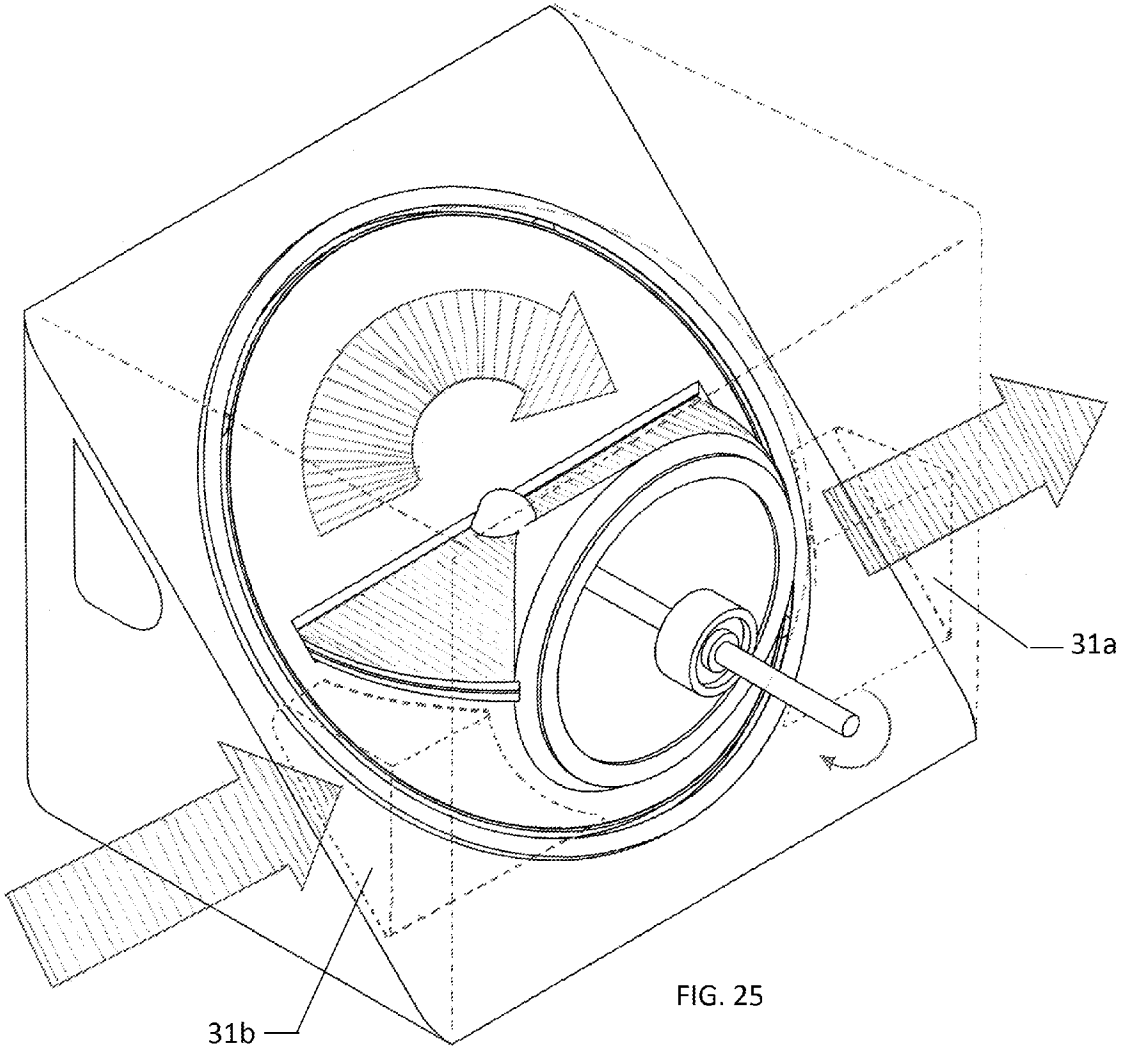
FIG. 25 further illustrates the continued flow of working fluid through the Ristau Orbital Engine during operation.

FIG. 25 illustrates the continuation of the flow of a working fluid through the Ristau Orbital Engine. FIG. 25 illustrates the point of rotation where the chamber volume is largest. The largest chamber area is defined as the area above the vanes or discs 41*a*, 41*b* when the discs are in horizontal position. From this point the chamber begins to contract with further clockwise rotation. In this position the working fluid on the upper side of the discs 41*a*, 41*b* is fully encapsulated in the spherical cavity of the block by the discs, conical rotor, and disc rotor. On the opposite side of the vanes or discs 41*a*, 41*b*, a first chamber is open to the higher pressure port 31*b* and a second chamber is open to the lower pressure port 31*a*. Rotation continues in a clockwise direction because of the disparity of pressure applied to the discs. As soon as the orientation of the core assembly and discs are beyond horizontal, the encapsulated working fluid is released on the side of the lower pressure port 31*a* as the chamber contracts on the lower pressure side and the chamber exposed to the higher pressure port expands. In this manner rotation is able to continue uninterrupted without the use of additional apparatuses such as valves, belts, or timing mechanisms. Further, at one point, there can be up to six chambers open.

FIGS. 24-25 illustrate the flow of working fluid through the chambers on one side of the disc rotor. The disc rotor bisects the Ristau Orbital Engine into two halves that are mirror images of each other. Therefore, the portion of the Ristau Orbital Engine on the opposite side of the disc rotor is follows the same process as described above. This allows for more consistency of pressure based on surface area of vanes or discs exposed to pressure. Consistent pressure relates directly to consistency of torque delivered to the shaft during rotation. The process is the same regardless of direction of rotation. In the aforementioned method, the rotation of the vanes or discs 41*a*, 41*b* and rotors are clockwise, however, the direction of rotation is determined by which port(s) are pressurized by a working fluid. Encapsulation of the working fluid inside of an expanding and contracting chamber allows processing of a pressurized working fluid without inefficiencies associated with a system where working fluid could escape by flowing over around or through it as in the case of turbines. An expanding and contracting chamber that converts from expanding to contracting without a series of valves, gears or timing mechanisms under isothermal compression allows for processing of a working fluid without regard to momentum or rate in the speed of rotation to reach the next phase of a cycle such as with a reciprocating engine. It is contemplated within the scope of the invention that any type of working fluid may be used for the rotary engine, including but not limited to fossil fuels such as gasoline, diesel butane/propane, natural gas, or any other earth produced hydrocarbon, or gaseous fluids such as air, oxygen, nitrogen, helium, hydrogen, carbon dioxide, sulfur dioxide, neon, or water vapor.

Figure 28:
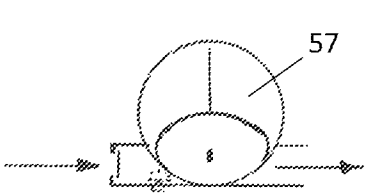
FIG. 28 illustrates one embodiment of the Ristau Orbital Engine using intermittent fuel ignition.
Figure 27:
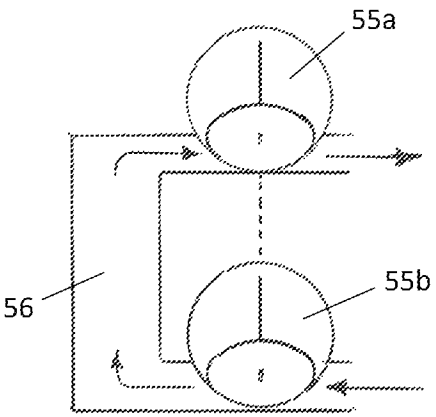
FIG. 27 illustrates one embodiment of a configuration of the Ristau Orbital Engine in an open or constant fuel burn configuration.
Figure 26:
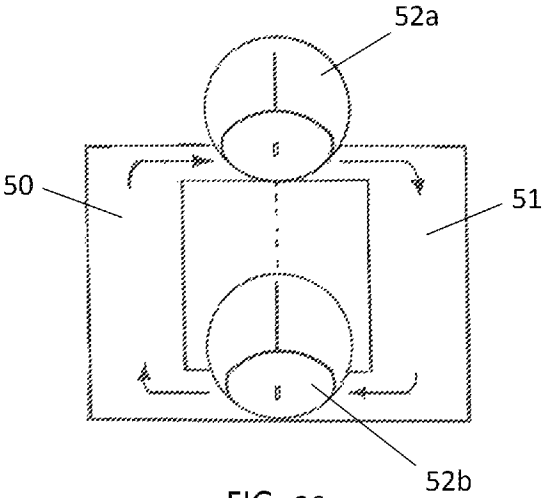
FIG. 26 illustrates one embodiment of a configuration of the Ristau Orbital Engine in a closed loop.

FIGS. 26-28 illustrate three possible configurations or embodiments for operation of the Ristau Orbital Engine. FIG. 26 illustrates one embodiment of an operation using essentially the Stirling cycle wherein a closed loop utilizes heat from an outside source to produce a thermal differential between a heat collector 50 and a heat sink 51. Reference numerals 52*a*, 52*b* illustrates a version of the operation of two Ristau Orbital Engines, respectively. As working fluid (not shown) is heated in the heat collector 50 portion the working fluid expands and a compression chamber is created via the pressure from the working fluid. The pressure from the fluid forces the Ristau Orbital Engine 52*a* to rotate. In operation, the working fluid is discharged into the heat sink 51 where the working fluid cools and contracts. Still referring to FIG. 26, a second Ristau Orbital Engine 52*b* is driven by the first Ristau Orbital Engine 52*a* directly or indirectly, and recirculates the cooler more dense working fluid from the heat sink to the heat collector where it re-heats to generate another cycle.

FIG. 27 illustrates another embodiment of operation as option for energy generation where increased power output in combination with smooth constant power generation is desired. In operation, fuel is introduced to a combustion chamber 56 exterior to the Ristau Orbital Engine 55*a*. On ignition, the working fluid (not shown) is heated in the combustion chamber 56, where it expands and enters the Ristau Orbital Engine 55*a* causing it to rotate. In operation, the working fluid is discharged via an outlet port. Still referring to FIG. 27, a second Ristau Orbital Engine 55*b* is driven by the first Ristau Orbital Engine 55*a* directly or indirectly and functions as a forced intake introducing a fuel/air mixture to the combustion chamber in order to continue operation.

FIG. 28 illustrates another embodiment of operation, wherein simplified energy generation with a Ristau Orbital Engine 57 can mimic a multi-stroke combustion engine. A fuel/air mixture is ignited outside of or inside of an inlet port. Here, a compression chamber is created by combustion of the fuel/air mixture and contained by the chamber and a valve or valves situated at or near inlet port. The pressure from the working fluid forces the Ristau Orbital Engine 57 to rotate. Momentum from the rotation of the core assembly facilitates the exhaust of the spent fuel/air mixture and the inlet of fresh fuel/air where it is ignited facilitating further operation.

It is contemplated within the scope of the invention that any number of Ristau Orbital Engines may be used, including but not limited to a plurality of Ristau Orbital Engines linked to one another in a series or parallel configuration. Furthermore, the Ristau Orbital Engines may operate in unison with each other or operate independent of each other.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense. While specific embodiments have been shown and discussed, various modifications may of course be made, and the invention is not limited to the specific forms or arrangement of parts described herein, except insofar as such limitations are included in the following claims. Further, it will be understood that certain features and sub-combinations are of utility and may be employed without reference to other features and sub-combinations. This is contemplated by and is within the scope of the claims.

The invention claimed is:

1. A rotary thermal engine, comprising:

an engine block having an enclosed interior space;

a first rotor and a second rotor;

the first and second rotors having a cone configuration with an interior hollow space and a circular base that tapers to an apex;

wherein the apex of the first rotor opposes the apex of the second rotor;

a first vane having a first and second side openings for receiving the first and second rotors;

a second vane positioned between the first and second rotor, wherein the second disc pivots relative to the first disc; and wherein the first and second rotors and first and second vanes are at least partially enclosed within the interior space of the engine block.

2. The rotary thermal engine of claim 1, further comprising a drive shaft coupled to the first or second rotor.

3. The rotary thermal engine of claim 1, wherein the second vane comprises an elongated opening for receiving the first vane.

4. The rotary thermal engine of claim 1, further comprising one or more ports on the engine block in communication with the interior space of the engine block.

5. The rotary thermal engine of claim 1, wherein the engine block is comprised of a first block and a second block coupled to each other.

6. The rotary thermal engine of claim 1, wherein the first and second rotor are configured to rotate about an axis.

7. The rotary thermal engine of claim 1, wherein the first and second vanes form at least two separate chambers within the interior space of the block.

8. The rotary thermal engine of claim 1, wherein the first block and second block each have an inlet and outlet port.

9. The rotary thermal engine of claim 1, wherein a first chamber is created within the interior space of the first block, and a second chamber is created within the interior space of the second block.

10. The rotary thermal engine of claim 9, wherein the first and second chamber each communicate with at least one port for receiving or expelling air.

11. A rotary thermal engine, comprising:

an engine block having an enclosed interior space for receiving a working fluid;

a first rotor and a second rotor, the first and second rotors each having a cone configuration that extends from a base to an apex;

wherein the apex of the first rotor opposes the apex of the second rotor;

a first disc having an opening at the center, wherein the apex of the first and second rotors is disposed within the center of the opening;

a second disc adjacent to the first and second rotors, the second disc having an elongated opening in its central region for receiving the first disc and a center bearing, wherein the second disc pivots relative to the first disc; and wherein the first and second rotors and first and second discs are at least partially enclosed within the interior space of the engine block.

12. The rotary thermal engine of claim 11, wherein the first and second rotors are further coupled to a drive shaft.

13. The rotary thermal engine of claim 11, wherein the working fluid is at least partially pressurized within the interior space.

14. The rotary thermal engine of claim 13, wherein the pressurized working fluid causes the first and second rotors to rotate about an axis.

15. The rotary thermal engine of claim 11, wherein the working fluid comprises one or more of: air, water, gas, or hydrocarbon.

16. The rotary thermal engine of claim 11, wherein the working fluid is from a geothermal source.

17. The rotary thermal engine of claim 11, wherein the working fluid enters the engine block from an inlet port, is then expanded within the interior space of the engine block, and then expelled from the interior space through an outlet.

18. A method of generating energy using a rotary thermal engine, the rotary thermal engine comprising first and second conical rotors each having an apex; wherein the apex of the first rotor opposes the apex of the second rotor; at least one disc having openings for receiving the first and second rotors, the method comprising:

receiving a working fluid at the rotary thermal engine from a source;

expanding the working fluid within a chamber of the rotary thermal engine, wherein the expanded working fluid causes at least one disc coupled to the first and second conical rotors to rotate, thereby generating rotational energy at a drive shaft coupled to the first and second conical rotors; and expelling the working fluid from the chamber of the rotary thermal engine.

19. The method of claim 18, wherein the working fluid is comprised of one or more of: air, water, gas, and hydrocarbon.

* * * * *

UNITED STATES PATENT AND TRADEMARK OFFICE

CERTIFICATE OF CORRECTION

PATENT NO. : 9,200,515 B2
APPLICATION NO. : 14/034507
DATED : December 1, 2015
INVENTOR(S) : Judson Paul Ristau It is certified that error appears in the above-identified patent and that said Letters Patent is hereby corrected as shown below:

In the claims

Column 9, Claim 1, line 63, delete “the second disc” and insert --the second vane--.

Column 9, Claim 1, lines 63-64, delete “the first disc” and insert --the first vane--.

Signed and Sealed this
Twelfth Day of April, 2016

Michelle K. Lee

Michelle K. Lee
*Director of the United States Patent and Trademark Office*